US008453444B2

(12) United States Patent
Haynes

(10) Patent No.: US 8,453,444 B2
(45) Date of Patent: Jun. 4, 2013

(54) POWER PLANT USING COMPRESSED OR LIQUEFIED AIR FOR ENERGY STORAGE

(76) Inventor: David Haynes, St. Peters, MO (US)

( * ) Notice: Subject to any disclaimer, the term of this patent is extended or adjusted under 35 U.S.C. 154(b) by 816 days.

(21) Appl. No.: 12/685,410

(22) Filed: Jan. 11, 2010

(65) Prior Publication Data

US 2011/0167814 A1 Jul. 14, 2011

(51) Int. Cl.
*F01B 29/10* (2006.01)

(52) U.S. Cl.
USPC ..... 60/512; 60/515; 60/659

(58) Field of Classification Search
USPC ..... 60/508, 512, 514, 515, 659
See application file for complete search history.

(56) References Cited

U.S. PATENT DOCUMENTS

| | | | | |
|---|---|---|---|---|
| 8,481 | A | 11/1851 | Ericsson | |
| 3,192,705 | A * | 7/1965 | Miller | 60/512 |
| 4,196,594 | A * | 4/1980 | Abom | 60/649 |
| 4,353,214 | A | 10/1982 | Gardner | |
| 4,765,142 | A | 8/1988 | Nakhamkin | |
| 4,849,648 | A | 7/1989 | Longardner | |
| 4,872,307 | A | 10/1989 | Nakhamkin | |
| 5,379,589 | A | 1/1995 | Cohn et al. | |
| 5,491,969 | A | 2/1996 | Cohn et al. | |
| 5,537,822 | A | 7/1996 | Shnaid et al. | |
| 5,634,340 | A | 6/1997 | Grennan | |
| 6,052,992 | A * | 4/2000 | Eroshenko | 60/509 |
| 6,637,207 | B2 | 10/2003 | Konezciny et al. | |
| 6,745,569 | B2 | 6/2004 | Gerdes | |
| 6,848,259 | B2 | 2/2005 | Kellner-Sornig et al. | |
| 7,073,335 | B2 | 7/2006 | Gerdes et al. | |
| 7,325,401 | B1 | 2/2008 | Kesseli et al. | |
| 7,356,383 | B2 | 4/2008 | Pechtl et al. | |
| 7,389,644 | B1 | 6/2008 | Nakhamkin | |
| 7,406,828 | B1 | 8/2008 | Nakhamkin | |
| 7,500,349 | B2 | 3/2009 | Althaus | |
| 7,614,237 | B2 | 11/2009 | Nakhamkin | |
| 7,640,643 | B2 | 1/2010 | Nakhamkin | |
| 7,661,268 | B2 | 2/2010 | Althaus et al. | |
| 7,663,255 | B2 | 2/2010 | Kim et al. | |
| 7,667,356 | B2 | 2/2010 | Togare | |
| 7,669,423 | B2 | 3/2010 | Nakhamkin | |
| 2008/0016879 | A1 * | 1/2008 | Watson et al. | 60/783 |
| 2011/0258999 | A1 * | 10/2011 | Ingersoll et al. | 60/512 |

* cited by examiner

*Primary Examiner* — Hoang Nguyen
(74) *Attorney, Agent, or Firm* — Polster, Leider, Woodruff & Lucchesi, LLC

(57) ABSTRACT

Apparatus (100) comprising a power plant or air motor utilizing compressed air or liquid air for energy storage. The apparatus includes an electrical plant (200), a mechanical plant (300), and a pneumatic plant (400). When operating as a compressor, the plant receives electrical and/or direct mechanical power as an input to drive the plant, compress air, and store its output in the form of compressed or liquefied air. When operating as an engine, the plant consumes the compressed or liquid air to drive a mechanism of the engine and deliver mechanical power and/or electrical power as an output.

10 Claims, 9 Drawing Sheets

Pneumatic Plant

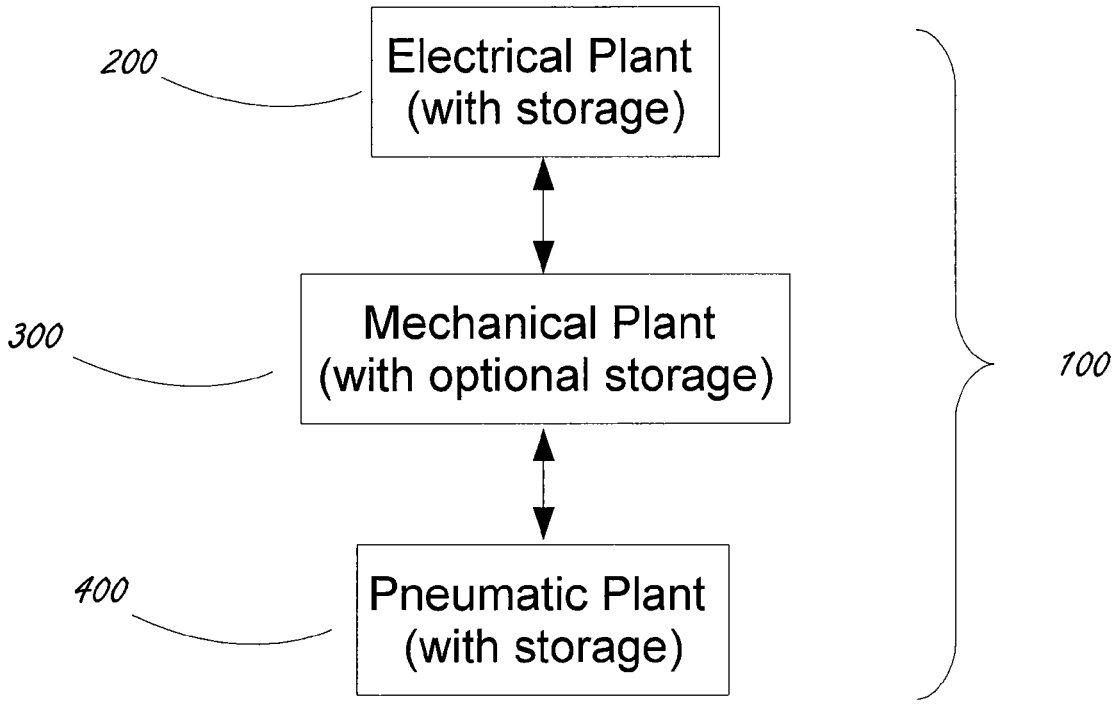
Figure 1 – System Block Diagram

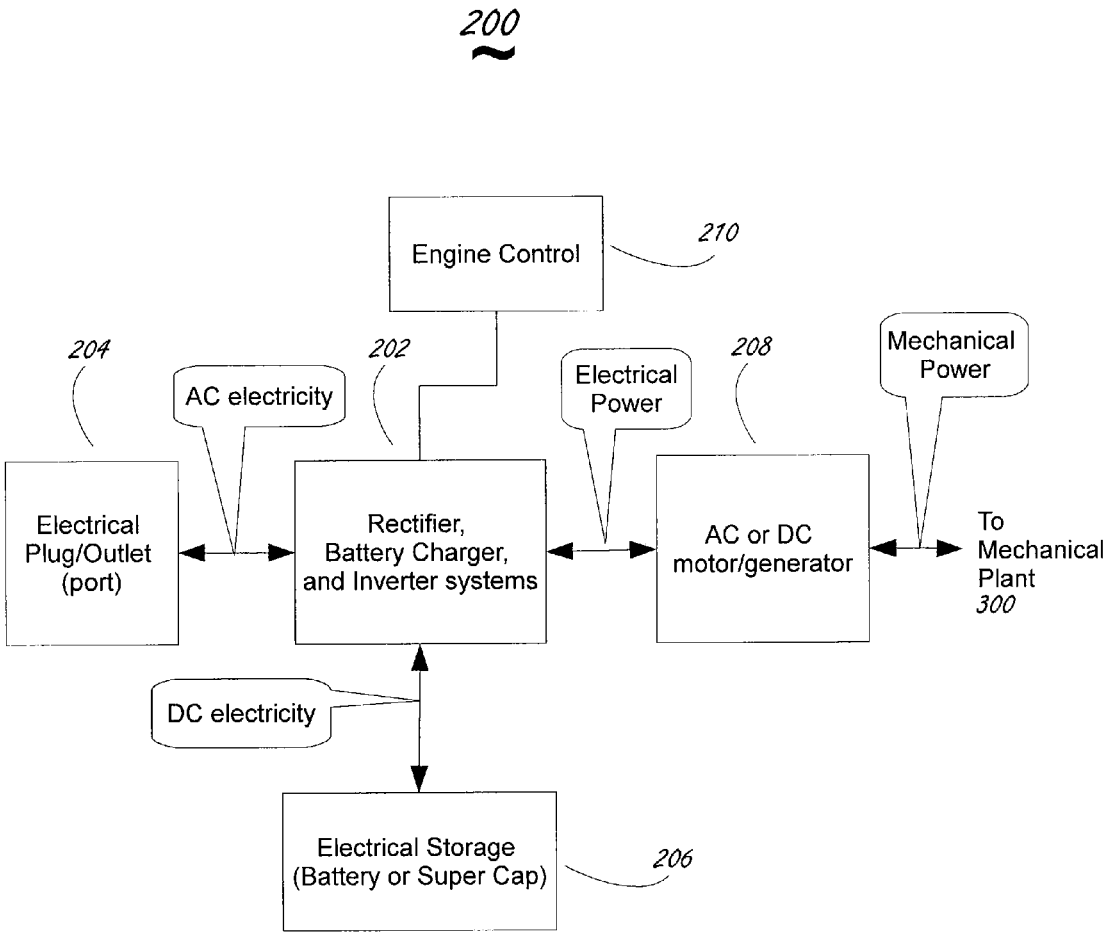
Figure 2 – Electrical Plant

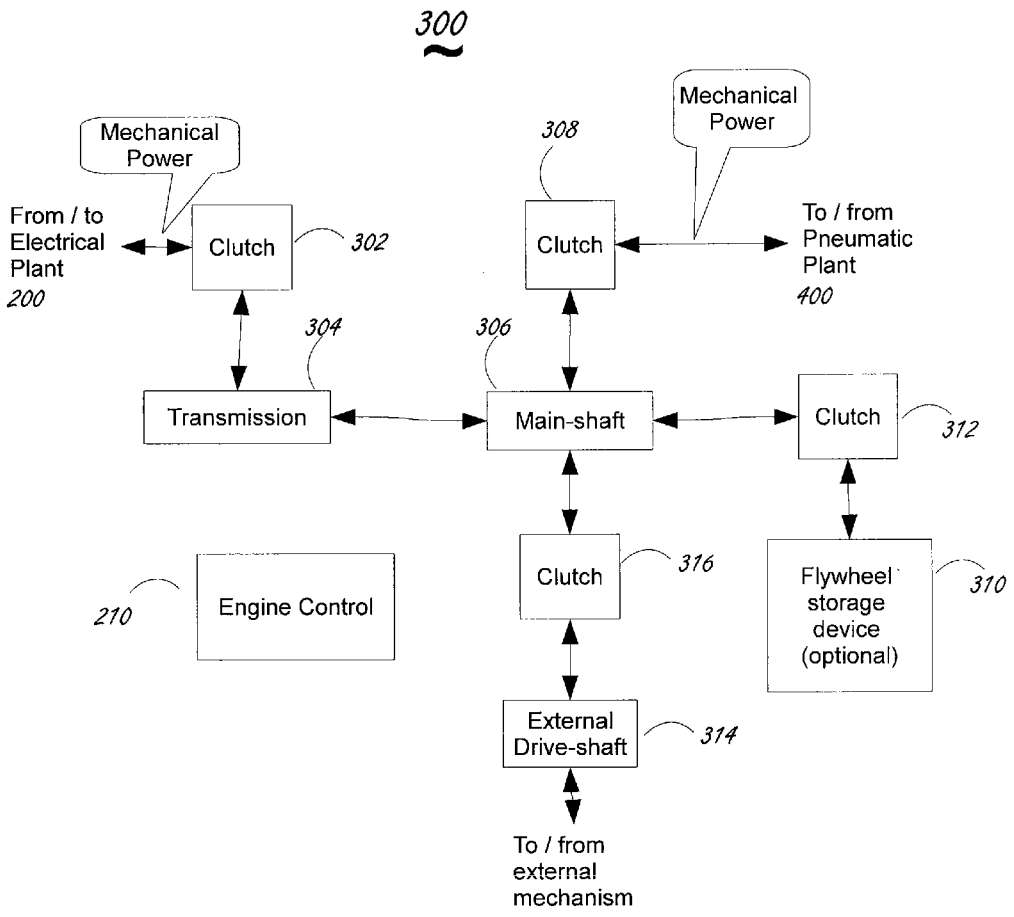
Figure 3 – Mechanical Plant

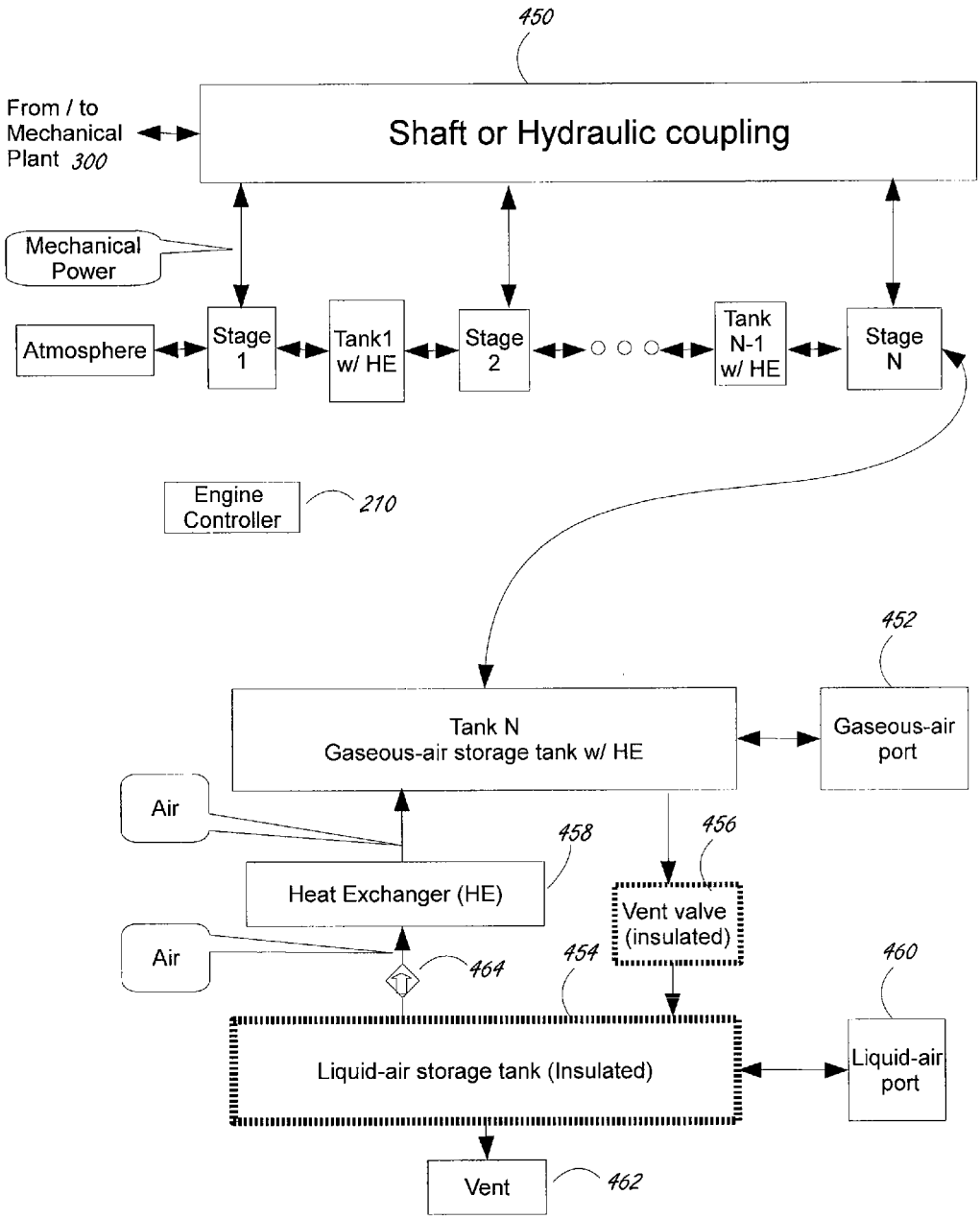
Figure 4 – Pneumatic Plant

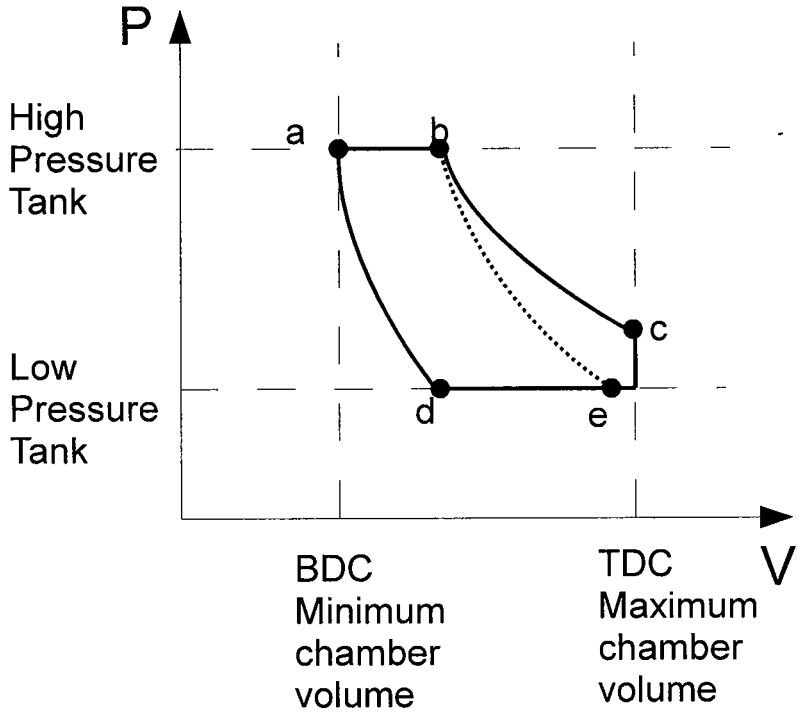
Figure 5 – Idealized PV Curve

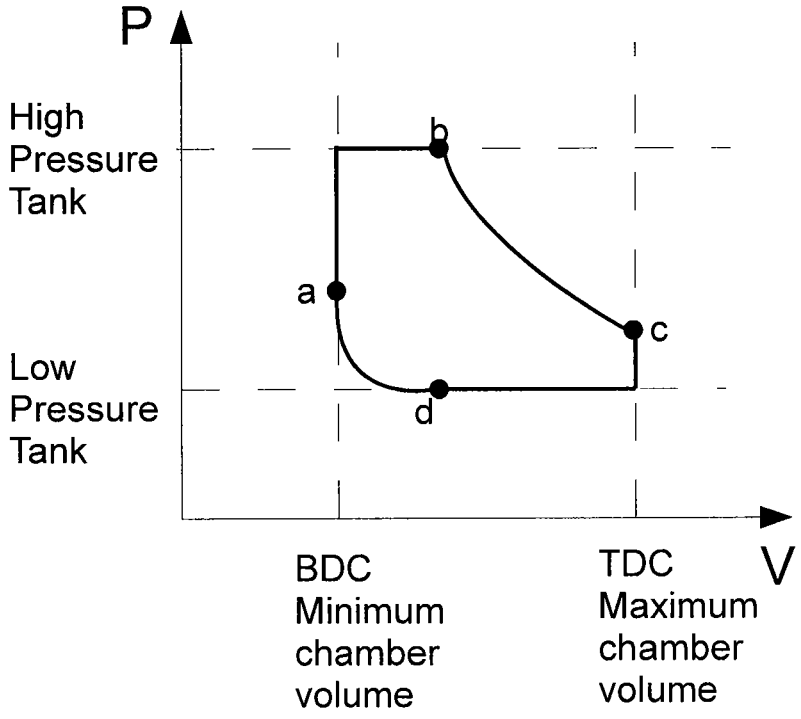
Figure 6 – Idealized PV Curve Without Tank Pressurization Prior To Power-stroke

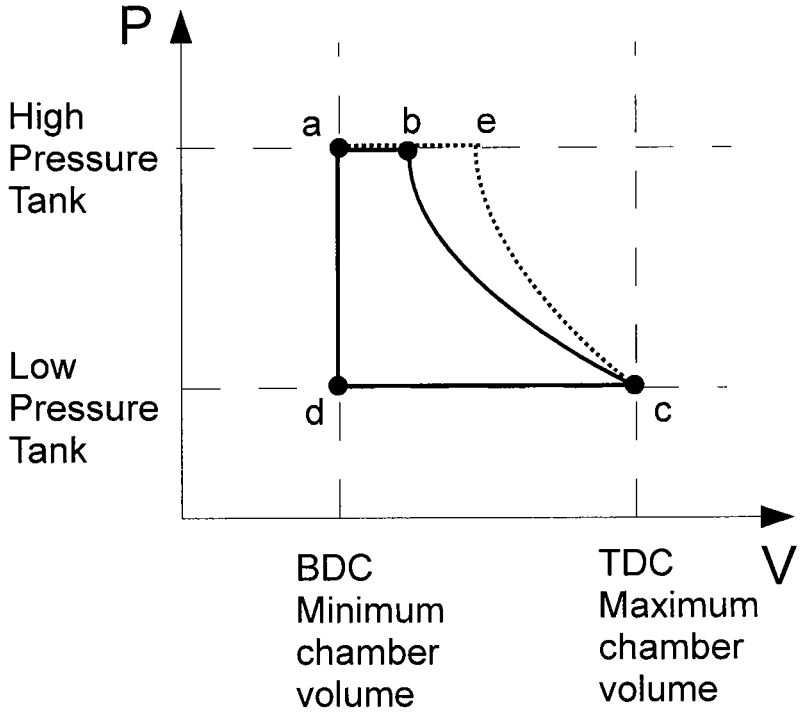
Figure 7 – Idealized Compression Cycle PV Curve

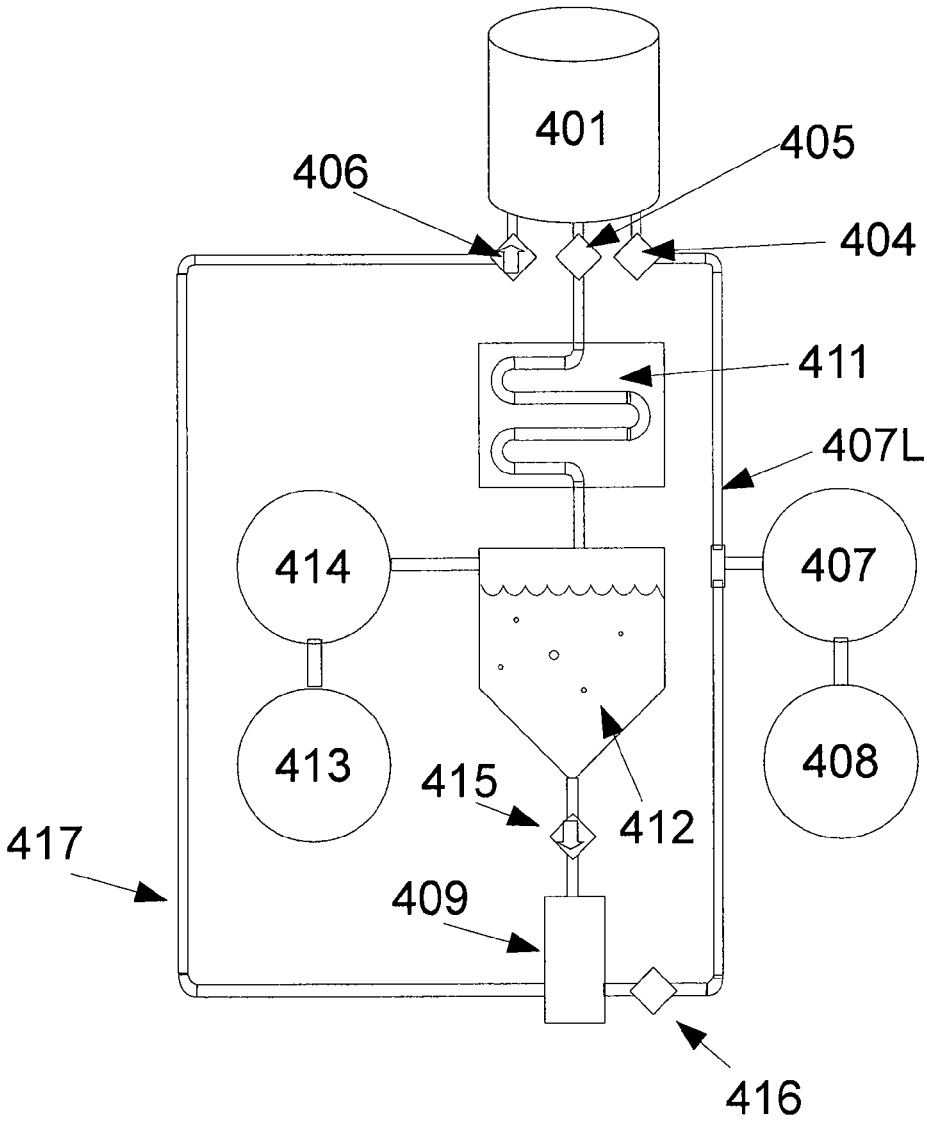
Figure 8 – Example Stage with Connection to High and Low Pressure Tanks

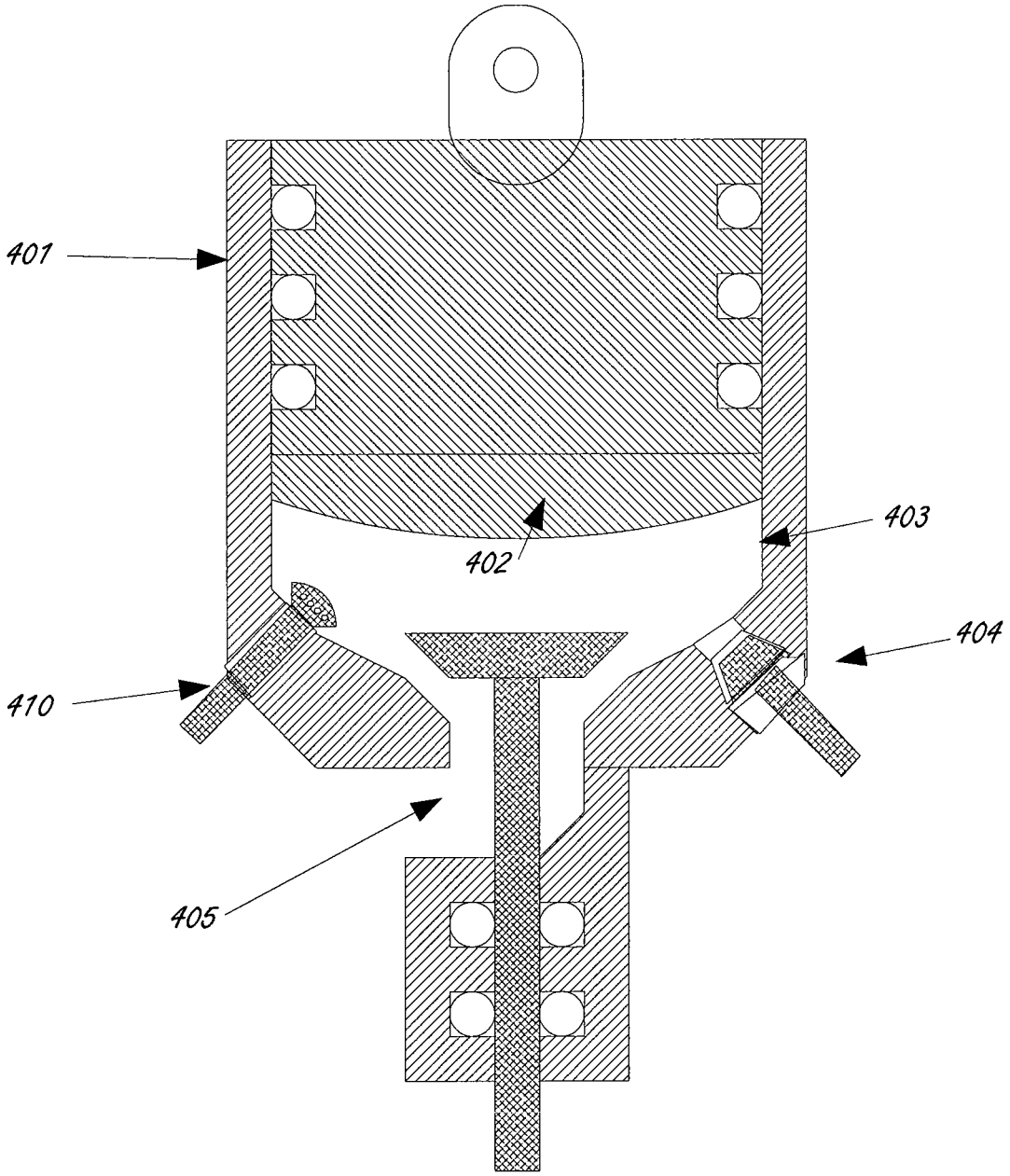
Figure 9 – Example Embodiment of Cylinder Assembly

POWER PLANT USING COMPRESSED OR LIQUEFIED AIR FOR ENERGY STORAGE

CROSS REFERENCE TO RELATED APPLICATIONS

None

STATEMENT REGARDING FEDERALLY SPONSORED RESEARCH OR DEVELOPMENT

N/A

BACKGROUND OF THE INVENTION

This invention relates to power generation; and more particularly to a power plant or air motor apparatus utilizing compressed air or liquid air for energy storage.

Fossil fueled power plants have been the mainstay of industry for over 100 years. While internal combustion engines have been firmly entrenched as the main power source for many applications, recent increases in the cost of crude oil have had a particularly devastating effect on industries that rely on engines powered by these fuels. Meanwhile, efforts to develop affordable alternatives to fossil fueled plants have proven challenging.

Electricity remains an attractive alternative power source. A reliable generation, transmission, and distribution system for electricity is already in place. Furthermore, electricity is generated from a diversity of sources including coal, nuclear, water (hydro), wind, and solar power. For most parts of the country, the regional cost of electrical energy is largely insensitive to the price of crude oil. Electricity has already been successfully used in certain transportation applications where the energy does not have to be stored—most notably, electric trains, buses, and trolleys. All of these vehicles obtain energy, as needed, from electrified rails or overhead cables. Unfortunately, electricity as a transportation power source has yet to gain widespread use in applications apart from electrified railways. The biggest challenge at this point is not to develop alternative methods of generating electricity, but to develop a means of storing the electrical power in a way suitable for use in the transportation sector. To be useful for common transportation applications, a technology would need to:

- Be suitable for use on non-electrified roadways, waterways, and airways.
- Provide sufficient range to the vehicle to make long journeys possible without refueling.
- Offer an economically viable alternative to consumers in terms of the acquisition, operational, and disposal costs.
- Offer reliable operation, and be easy to repair and maintain.
- Be scalable.
- Be safe to use.
- Be environmentally friendly (by eliminating carbon emissions and minimizing any contribution to landfills.)

While batteries are an obvious choice for electrical energy storage, they don't necessarily satisfy all of the requirements outlined above. There are alternatives to the use of chemical batteries for the bulk storage of electrical energy. One such alternative is to store air (in a compressed gas or liquid form) and use it as needed. Much like batteries which convert electrical energy to chemical potential energy (and back again), so also will a compressed-air energy storage (CAES) system convert electrical energy to compressed-air potential energy (and back again). While a battery generates electricity on demand by a chemical reaction, so also will a CAES system generate electricity on demand by releasing compressed air to drive an electrical generator. Unlike the battery, the CAES system also has the option of using the pressurized air directly to drive an air motor and perform mechanical work (with or without accompanying electrical generation).

The use of compressed air as an alternative means of storing energy is not new. U.S. Pat. No. 8,481 (dating from the 1850's) describes an early air engine. Many developments have occurred since that time; but with the historical affordability of crude oil, and the dependability and effectiveness of the internal combustion engine in performing work, there has been little incentive for industry to develop other technologies, such as CAES, as an alternative power source. While the internal combustion engine became the dominant technology for transportation, air motors have found use in other applications such as for portable tools. In their development, air motors gained a reputation for affordability and longevity; but, unfortunately, also for inefficiency.

For compressed air to be considered a viable means of energy storage for transportation purposes, the air motor must be efficient enough to reach transportation design goals in a manner similar to that of the internal combustion engine. Without sufficiently high efficiency, the volume of air that must be transported would be prohibitive for most applications, and CAES will remain an unattractive design alternative.

Most engines (internal combustion engines, jet engines, and the like) burn a fuel which transfers heat into the gas. The resulting rise in gas temperature causes an increase in gas pressure. The design of the engine allows this increase in pressure to be traded for an increase in volume and the force of the gas acting on a movable surface translates to work done by the engine.

Air motors, in contrast to internal combustion engines, don't burn fuel; but instead route air from a high-pressure storage tank into a cylinder to pressurize the cylinder. At high rpm, the compressed gas expands rapidly (following essentially an adiabatic process) and cools dramatically as it expands. The exhaust expelled from the motor can be cryogenic. Such temperatures impose a limit on the efficient operation of the air motor because, at cryogenic temperatures, air loses pressure and consequently its effectiveness as a propellant.

U.S. Pat. No. 1,926,463 describes a compressed air motor which warms cold exhaust air using a heat exchanger. This prepares the air for use by a subsequent stage, but does nothing for the air in the original cylinder as it undergoes a power stroke. In a similar manner, U.S. Pat. No. 7,296,405 transfers air from one cylinder to another in an effort to counteract the cooling effect of expansion. A drawback in this process is that, in doing so, the system has to expend energy to compress the ambient air. A similar drawback is found in the systems described in Japanese publications JP02245401 A2 and JP07314315 A2, as well as publications WO9504208 A1 and EP0666961 A1.

U.S. Pat. No. 4,311,917 describes a system that consumes liquid air and uses it to generate electricity, charge batteries, and power an assembly. While the invention described herein also connects systems together to create a power plant, it is of a significantly different design than that described in the U.S. Pat. No. 4,311,917.

U.S. Pat. No. 4,432,203 describes use of an atomized spray of water to affect the temperature of the working fluid. As described therein, water is sprayed into a hot chamber where it immediately flashes into steam. The resulting hot water vapor transfers heat to air in an expansion chamber. In contrast, the present invention uses water near its ambient temperature to warm air in an expansion chamber which would otherwise be near cryogenic. No fuel is burned in the air motor of the present invention to create heat as is necessary in the U.S. Pat. No. 4,432,203.

Modern, large-scale CAES systems are used for the bulk storage of power by electric utilities. As such, the CAES system serves as a peaking power plant to stabilize the utility's electric grid. The systems are large systems typically requiring an underground cavern in which to store the compressed air. Most such systems also use a process which burns fuel to heat the air as the pressurized air is converted to mechanical energy. The present invention could be used as a CAES system; however, it has the advantage of avoiding the burning of fuel. Also, a major drawback of current CAES technology is that large tanks (or sealed underground caverns) are required to store the pressurized air. A liquid air energy storage (LAES) system such as taught by the present invention avoids this difficulty by storing the bulk of the air as a liquid rather than as a gas. Efficient production of liquid air requires cool, compressed air, and the present invention can be readily used for the production of liquid air. Liquid air is easily converted to a gaseous compressed air by warming, and air engines have been designed to use gaseous air, liquid air, or both.

BRIEF SUMMARY OF THE INVENTION

The present disclosure is directed to apparatus comprising a power plant utilizing compressed air or liquid air for energy storage. The energy storage system contains an air motor which can operate in a reversible manner as an air compressor. The air motor (compressor) is also very efficient. When storing energy, the system receives electrical and/or direct mechanical power as an energy input. When the air motor operates as a compressor, the system stores the output in one or more tanks of compressed or liquefied air. When releasing energy, the system consumes the compressed or liquefied air previously created. The motor is driven by the air to generate mechanical power. The system can offer mechanical power and/or electrical power as its energy output.

Importantly, the present invention uses the environment (atmosphere) as a heat reservoir. That is, it dumps heat generated during its operation as a compressor into the environment, and then draws heat back from the environment when operating as a motor.

The energy storage system consists of three main interconnected parts:

a) an electrical plant;

b) a mechanical plant; and, c) a pneumatic plant.

When the pneumatic plant is operating as an air compressor to charges its tanks, the apparatus acts to achieve an isothermal compression of the gas (its working fluid) so to minimize the work required to compress a given volume of gas. By maintaining a (near) constant temperature for the pressurization of the gas, the air motor not only minimizes the work input, but also facilitates conversion of the compressed gas (air) to its liquid state. Similarly, when the plant is discharging its tanks (operating as an air motor), the apparatus endeavors to maintain an isothermal expansion of the working fluid in order to maximize work output from the motor. The apparatus improves the pressure during the expansion phase of its power stroke over conventional air motor designs which would otherwise allow an adiabatic expansion of the working fluid. Those skilled in the art will appreciate that the invention can also be applied in the warming of liquid air to create gaseous air.

To achieve these goals, a synergist liquid (e.g., an antifreeze laden water) is introduced into the working fluid during its expansion (or compression) and thoroughly mixed with the working fluid. During the expansion phase of the operation, this has the effect of adding heat to the working fluid (air) without the burning of fuel. The thermal mass of the synergist liquid provides heat that is shared with the working fluid. Likewise, during the compression phase of the operation, the thermal mass of the synergist liquid effectively cools the air. This reduces the pressure and therefore the work required for compression. The synergist liquid is an incompressible liquid and does not react in the same way that gaseous air does to changes in pressure or volume. This, in turn, allows the synergist liquid to be easily separated from the working fluid and recovered for reuse.

Other objects and features of the invention will be in part apparent and in part pointed out hereinafter.

BRIEF DESCRIPTION OF THE SEVERAL VIEWS OF THE DRAWINGS

The objects of the invention are achieved as set forth in the illustrative embodiments shown in the drawings which form a part of the specification.

FIG. 1 is a system block diagram indicating the electrical, mechanical, and pneumatic plants which comprise the apparatus;

FIG. 2 is a block diagram of the electrical plant portion of the apparatus;

FIG. 3 is a block diagram of the mechanical plant portion of the apparatus;

FIG. 4 is a block diagram of the pneumatic plant portion of the apparatus;

FIG. 5 illustrates an idealized pressure-volume (PV) curve used to describe operation of the apparatus;

FIG. 6 illustrates another PV curve used to describe an alternative operation of the apparatus;

FIG. 7 illustrates a PV curve used to describe the compression cycle of he apparatus;

FIG. 8 illustrates an exemplary stage of the apparatus with connection between high and low pressure tanks of the apparatus; and, FIG. 9 is a sectional view of an exemplary cylinder assembly of the apparatus which provides a volumetric expansion/compression chamber.

Corresponding reference characters indicate corresponding parts throughout the several views of the drawings.

DETAILED DESCRIPTION OF INVENTION

The following detailed description illustrates the invention by way of example and not by way of limitation. This description clearly enables one skilled in the art to make and use the invention, and describes several embodiments, adaptations, variations, alternatives and uses of the invention, including what is presently believed to be the best mode of carrying out the invention. Additionally, it is to be understood that the invention is not limited in its application to the details of construction and the arrangement of components set forth in the following description or illustrated in the drawings. The invention is capable of other embodiments and of being practiced or carried out in various ways. Also, it will be understood that the phraseology and terminology used herein is for the purpose of description and should not be regarded as limiting.

Referring to the drawings, a multi-mode power plant 100 utilizes Compressed Air Energy Storage (CAES) and/or Liquid Air Energy Storage (LAES). The power plant includes three sections: an electrical plant 200 having a storage capability, a mechanical plant 300 also having a storage capability, and a pneumatic plant 400 also having a storage capability.

As shown in FIG. 2, in electrical plant 200, a rectifier/battery charger/inverter module 202 is supplied AC power from a port 204. DC power is supplied to the module from a storage module 206 which can be, for example, a battery or large (super) capacitor. From module 202, electrical power is supplied to an electrical engine which functions as a motor/generator 208. Operation of the motor or generator is provided by an engine control 210 through module 202. The motor/generator is coupled to mechanical plant 300.

Referring to FIG. 3, mechanical plant 300 is connected to motor/generator 208 of electrical plant 200 through a clutch 302 and transmission assembly 304. Transmission assembly 304 is connected to a main shaft 306 of the mechanical plant. The main shaft, in turn, connects to mechanical plant 400 through a clutch 308, to a flywheel storage unit 310 through a clutch 312, and to an external drive shaft 314 through a clutch 316.

Mechanical plant 300 interfaces with pneumatic plant 400 through a shaft or hydraulic coupling 450. The pneumatic plant incorporates a number of stages (labeled "1" through "N" in the figure) with a separate tank associated with each stage. Tank N is a gaseous air storage tank connected to a port 452. Tank N is also connected to an insulated liquid-air storage tank 454 through a vent valve 456 and a heat exchanger 458. Tank 454 has an associated port 460, as well as a vent 462.

The pneumatic plant 400 portion of the system can operate as an air engine as well as an air compressor. As is known in the art, the compression and expansion of air involves the operation of a volumetric displacement chamber 401 as shown in FIG. 9. The preferred embodiment of this chamber utilizes a dual-acting reciprocating piston. For illustrative purposes, a single-acting, two-stroke system is described which contains a piston 402 within a cylinder 403. Other embodiments are possible (e.g. a fluid piston engine, or rotary engine) within the scope of the invention. FIG. 9 illustrates an example of a chamber 401 in which the maximum volume is attained when piston 402 is at its Top Dead Center (TDC) position, and when the minimum volume is at the piston's Bottom Dead Center (BDC) position. Each cylinder 403 has supporting equipment (not shown) to route air and fluids. The resulting assembly forms a "stage." in order to maximize efficiency, power-plant 100 operates in multiple stages with each stage forming a closed loop cycle for fluids. The fluids are returned to ambient temperature after use within the chamber 401.

As described herein, plant 400 can operate as an air compressor to charge the tanks "1" through "N." In doing so, the apparatus affects an isothermal compression of a working fluid (the gas) in order to minimize the work required to compress a given volume of the gas. By maintaining a near constant temperature for pressurization of the gas, the air motor minimizes the work input and facilitates conversion of the compressed gas to its liquid state.

When plant 400 is discharging its tanks while operating as an air motor, the apparatus acts to maintain an isothermal expansion of the working fluid so to maximize work output from the motor. The result is a significant increase in pressure during the expansion phase of the air motor's power stroke over conventional air motor designs which allow an adiabatic expansion of the working fluid. It will be appreciated by those skilled in the art that the invention is also useful in warming liquid air to create gaseous air.

Operation as an Engine

Referring to FIGS. 8 and 9, when an inlet valve 404 to chamber 401 is open, and an exhaust valve 405 from the chamber is closed, a working fluid for the chamber is obtained from a manifold 407 through a flow line 407L. This working fluid may be either liquid air or gaseous air. Now, piston 402 undergoes the first part of its power stroke (i.e., to point a in the diagram of FIG. 5), and is forcibly moved under full pressure from a high-pressure tank 408 to which manifold 407 is connected. Ideally, the working fluid is maintained at an ambient temperature.

At some point, depending on the need for power to serve a load, inlet valve 404 closes. Piston 402 continues to move because the air pressure within cylinder 403 is much higher than the atmospheric pressure. The trapped gas continues to expand within the cylinder which, in turn, results in a drop in temperature. To counteract this effect a synergist fluid (e.g., water mixed with antifreeze and maintained at ambient temperature) is now injected into the cylinder. Valve 416 is opened. The synergist liquid flows from a reservoir 409 through a check-valve 406 to an injector 410. Atomized droplets of the liquid now thoroughly mix with the expanding air within cylinder 403. The liquid acts as a synergist to modify the behavior of the expanding gas by interacting with the air molecules and raising the working fluid's temperature back towards ambient. The liquid also serves to lubricate the sliding surfaces and o-ring seals.

Piston 402 continues to move. After a predetermined amount of the liquid has been injected into chamber 403, valve 416 closes. The piston continues to move until it reaches the ends of its power stroke at its TDC position.

An exhaust stroke now begins with the opening valve of valve 405. Valve 415 opens at this time to replenish the fluid in reservoir 409. Cylinder 403 is designed so that both liquid and air are evacuated from chamber 401 through exhaust valve 405 as piston 402 moves back to its BDC position. Both the liquid and air are warmed as they flow through a heat exchanger 411. From the heat exchanger, the synergist liquid and air enter a separator tank 412; where, because of the pressures involved, the air and synergist liquid readily separate. Exhaust valve 405 closes when piston 402 reaches its BDC position. While the liquid flows back into reservoir 409, the separated air is drawn from separator tank 412 to a low pressure tank 413 through a low-pressure manifold 414.

The compression portion of the cycle begins with piston 402 moving back to its TDC position. Preferably, exhaust valve 405 is closed such that air pressure within cylinder 403 is approximately equal to the high pressure level of tank 408 just as the piston reaches TDC. The compression stroke is complete when piston 402 reaches TDC, and the 2-stroke engine process described is now ready to be repeated. It will be understood by those skilled in the art that not all of the liquid drawn from reservoir 409 is necessarily completely evacuated from cylinder 403 during each cycle. Further, another approach to thoroughly mix the two fluids, rather than using an atomizing spray, is to have the working fluid bubble up through the synergist fluid. This can be accomplished using any fluid mixing approach to facilitate heat transfer.

The diagram of FIG. 5 illustrates operation of the apparatus in terms of an idealized Pressure/Volume curve. The curve resembles that of a Brayton cycle. However, operation of the air engine of the present invention is quite different than that of a jet turbine engine. In FIG. 5, the power stroke of the invention begins at point a, with the opening of inlet valve 404 and follows the curve clockwise under full power (full pressure from high pressure tank 408) to point b. At some point, which is based on a target rpm and other engine factors, the inlet valve is closed and the remainder of the power stroke occurs. Under ordinary conditions, an adiabatic expansion would occur, and the PV curve of FIG. 5 would follow path b-e. However, because in accordance with the present invention, the synergist liquid is injected into chamber 403 through atomizer 410 to warm the gas, the result is that the PV curve follows path b-c instead. This completes the power stroke of the engine. At the start of the exhaust stroke, exhaust valve 405 opens. The PV curve now follows path c-d. At point d the exhaust valve 405 closes, and a partial compression cycle begins. The PV curve now follows path d-a back to the starting point and the cycle is completed.

It will be understood by those skilled in the art that the pressurization of cylinder 403 prior to the power stroke may vary. FIG. 6, for example, illustrates a PV curve that would result without prior pressurization of chamber 401. Importantly, introduction of the synergist liquid into the working fluid during the expansion phase, and thoroughly mixing it with the working fluid has the advantage of adding heat to the working fluid without burning fuel. This is because the thermal mass of the synergist liquid provides heat that is shared with the working fluid. Conversely, during the compression phase, the thermal mass of the synergist liquid cools the air, reducing the pressure and therefore the work required for compression. Since the synergist liquid is incompressible, it does not react in the same way gaseous air does to changes in pressure or volume. This allows the synergist liquid to be easily separated from the working fluid and recovered for reuse. It will also be noted that no fossil fuels are burned in the power plant during the process so that the apparatus is non-polluting and environmentally "friendly". Rather, heat from the atmosphere is added to the working fluid at appropriate times in the process.

Operation as a Compressor

Before the apparatus of the present invention can operate as an engine, high-pressure tank 408 needs to be charged. Apart from refueling with gaseous or liquid air from another source, the power plant can be operated in a reverse mode to serve as an air compressor. In this regard, operation as an air compressor can be accomplished in one of several ways. Initially, high-pressure tank (or tanks) 408 is empty. Any air pumped into the tanks has a minor effect on tank pressure, but significant heat cannot be generated until significant pressure is present in the system. Use of an atomized liquid is optional until lubrication and/or heat conditions require it.

With piston 402 starting at its BDC position, air from low pressure tank 413 through low pressure manifold 414 enters cylinder 403 through valve 405. When the piston arrives at its TDC position, valve 405 is closed.

Now, a compression cycle begins. As pressure in cylinder 403 approaches the pressure level of high-pressure tank 408 (via manifold 407, inlet valve 404 is opened. As the piston reaches its BDC position, this valve is closed and the cycle is complete.

This technique can be used for short periods of time (such as for regenerative braking). However, to operate for extended periods of time, occasional lubrication is required. An engine controller 415 (see FIG. 4) can modify the ordinary compression cycle described above to inject liquid to both cool and lubricate the piston/cylinder mechanism. The liquid is routed to cylinder 403 during the intake stroke by briefly opening reservoir 409 and allowing liquid flowing from the reservoir to flow through check valve 410 into the cylinder. The need for a liquid to serve as a coolant in chamber 401 increases as a function of the pressure level in high pressure tank 408.

FIG. 7 illustrates a PV curve for the compression cycle. When the temperature is properly managed, the cycle follows the path a-d-c-b-a. When operating in a mode in which the cylinder temperature is not managed, the cycle tends to follow the less efficient a-d-c-e-b-a path.

The various valves are controlled such that their timing varies in response to engine requirements. While this can be accomplished in several ways, including electromechanically, the preferred embodiment is to operate the valves mechanically. Adjustments can be made to the configuration of the injection mechanism in response to engine requirements. In this regard, the cam for each lifter will have a three dimensional profile and the cam is maneuvered along its axis of rotation to present a shape to the lifter that corresponds to the amount of "fuel" to be dispensed.

Multiple Tanks

FIG. 9 shows an example of a single stage of mechanical plant 400. As noted, FIG. 4 shows that plant 400 can have multiple stages with each stage having an associated tank. Tanks are positioned so that one serves as a high pressure tank 408 (labeled "1" through "N") and one serves as a low pressure tank 413 (labeled "atmosphere" through "N−1"). For example, stage 1's high pressure tank 408 is labeled "Tank 1" and its low pressure tank 413 is labeled "atmosphere". Stage N's high pressure tank 408 is labeled "Tank N", and its low pressure tank 413 labeled "Tank N−1". Each stage of plant 400 functions to convert mechanical energy to or from energy using compressed air. The respective stages can be connected in parallel, in series, or in a combination thereof.

Tank N is a tank of gaseous air at the upstream end of the highest pressure stage (stage N), and tank 454 is a tank of liquid air also at this upstream end. As such, both tank N and tank 454 are the highest pressure tanks. When the system is operated as an air compressor, the pressure in the final gaseous-air tank, tank N, will increase. When its pressure exceeds a predetermined value, vent valve 456 opens to relieve the pressure. The air is routed to insulated tank 454 where it rapidly expands. The adiabatic expansion results in rapid cooling and conversion of the air to a liquid. When the system is operated as an air engine, and the pressure in tank N is inadequate, liquid air is brought over from tank 454, through pump/valve 464, and allowed to warm in the heat exchangers. The fluid mixing apparatus, as described above, now acts to efficiently convert the liquid air to gaseous air.

Power plants of many different sizes are conceivable within the scope of the invention. When the power plant is small, it might be called an "air motor." When the power plant is large, it might be called an "air engine." While the term "air" is used throughout this description to refer to the working fluid, the term encompasses any, or all, components of air including nitrogen, carbon dioxide, etc. The working fluid (i.e. air) may be in a gaseous or liquid form with the preferred embodiment having gaseous-air flowing in and/or out of each stage as the working fluid. Further, it is important to note that the power plant of the invention burns no fossil fuels during its operation either as an engine or as a compressor. Accordingly, the power plant is a "green" plant and does not add to atmospheric pollution. In this regard, power plant 100 releases heat generated during its operation as a compressor into the environment, and then draws the heat back out of the environment when operating as a motor.

In view of the above, it will be seen that the several objects and advantages of the present disclosure have been achieved and other advantageous results have been obtained.

Having thus described the invention, what is claimed and desired to be secured by letters patent is:

1. A power plant for storing energy in the form of compressed air or liquefied air and for selectively releasing the stored energy when desired by an energy user comprising:

an electrical plant;

a mechanical plant operatively connected to the electrical plant;

a pneumatic plant operatively connected to the mechanical plant, the power plant executing a process by which a working fluid comprising either a gas or a liquid which converts to gas undergoes a volumetric expansion or compression, a synergist fluid comprising an incompressible fluid which is added to the working fluid during a volumetric change in the working fluid, the synergist fluid being thoroughly mixed with the working fluid for the process to be a substantially isothermal process;

the pneumatic plant including at least one heat exchanger for maintaining the temperature of the synergist fluid and at least one tank containing the working fluid and at least one tank containing the synergist fluid;

the pneumatic plant further including a cylinder and a piston reciprocally movable through the cylinder, maximum volume within the cylinder being attained when the piston is at a top dead center position and the minimum volume occurring when the piston is at its bottom dead center position, the cylinder and piston being operated as an air compressor during which operation the pneumatic plant maintains a near constant temperature for pressurization of the working fluid so to minimize work input and facilitate conversion of compressed gas to its liquid state; and, the synergist fluid being a liquid having a thermal mass greater than the thermal mass of the working fluid, the synergist fluid remaining in its liquid state liquid throughout the range of temperatures and pressures encountered during the process, the working fluid expanding during a power stroke portion of the process with a concomitant decrease in the temperature of the working fluid, the synergist liquid being added to the working fluid at this time so to raise the temperature of the working fluid so to improve the efficiency of the power plant when it operates as an engine.

2. The power plant of claim 1 which can also operate as a compressor.

3. The power plant of claim 2 in which the working fluid is compressed during a compression stroke portion of the process with a concomitant increase in the temperature of the working fluid, the synergist fluid being added to the working fluid at this time so to lower the temperature of the working fluid and improve the efficiency of the compressor.

4. The power plant of claim 3 in which no fossil fuels are burned but in which heat is drawn from the atmosphere and added to the working fluid at an appropriate time during the process.

5. A power plant of claim 1 further including at least one tank in which the compressed air or liquefied air is stored so to store energy.

6. The power plant of claim 5 further including a plurality of tanks for the bulk storage of energy.

7. The power plant of claim 1 having a plurality of stages processing the working fluid, each stage including a volumetric displacement mechanism with which to process the working fluid.

8. The power plant of claim 1 in which stored energy in the form of compressed air is used in the pneumatic plant.

9. The power plant of claim 1 in which stored energy in the form of liquefied air is used in the pneumatic plant.

10. The power plant of claim 1 in which the pneumatic plant discharges the tanks for the working fluid so to maintain a substantially isothermal expansion of the working fluid and maximize work output from the air motor, this resulting in a significant increase in pressure during an expansion phase of the air motor's power stroke and producing a substantially adiabatic expansion of the working fluid.

* * * * *